US006922929B1

(12) United States Patent
Schramek

(10) Patent No.: US 6,922,929 B1
(45) Date of Patent: Aug. 2, 2005

(54) WIPER-MOUNTED DISPLAY OF SPORTS TEAM AFFILIATION

(76) Inventor: Robert J. Schramek, 5630 11th Ave. North, St. Petersburg, FL (US) 33710

( * ) Notice: Subject to any disclaimer, the term of this patent is extended or adjusted under 35 U.S.C. 154(b) by 10 days.

(21) Appl. No.: 10/708,865

(22) Filed: Mar. 29, 2004

Related U.S. Application Data

(60) Provisional application No. 60/460,563, filed on Apr. 7, 2003.

(51) Int. Cl.[7] ..... G09F 21/04

(52) U.S. Cl. ..... 40/591; 15/250.01

(58) Field of Search ..... 40/591, 597, 424, 40/425, 643; 15/250.01

(56) References Cited

U.S. PATENT DOCUMENTS 2,387,953 A * 10/1945 Terry ..... 340/481
3,231,951 A * 2/1966 De Armond ..... 248/475.1
4,953,315 A * 9/1990 Romaine ..... 40/593
5,080,941 A * 1/1992 Kosowan ..... 428/31
5,715,620 A * 2/1998 Walker ..... 40/591
5,933,991 A 8/1999 Gaul

FOREIGN PATENT DOCUMENTS

JP 09315271 A * 12/1997 ..... B60S/1/58

* cited by examiner

*Primary Examiner*—Cassandra Davis
(74) *Attorney, Agent, or Firm*—Ronald E. Smith; Smith & Hopen, P.A.

(57) ABSTRACT

An apparatus that indicates the sports team affiliation of a vehicle operator includes a first part that moves conjointly with a windshield wiper and a non-moving second part mounted to the vehicle. The moving part is mounted to the wiper arm but not to the wiper blade. A first bracket is mounted to the first part near its radially inner end and a second bracket is mounted to the first part near its radially outer end. A first tie secures a radially inner end of the wiper arm to the first bracket and a second tie secures a radially outer end of the first part to the second bracket. The non-moving second part is secured to the vehicle with suction cups. In a second embodiment, the non-moving part is eliminated and only the moving part is provided.

4 Claims, 6 Drawing Sheets

WIPER-MOUNTED DISPLAY OF SPORTS TEAM AFFILIATION

CROSS-REFERENCE TO RELATED DISCLOSURES

This disclosure claims priority from a provisional application entitled: "SuperSwiper," filed Apr. 7, 2003 by the present inventor and bearing application No. 60/460,563.

BACKGROUND OF INVENTION

1. Field of the Invention

This invention relates to mechanical devices that indicate a user's support of a sports team or other club or organization having an insignia or logo. More particularly, it relates to a device that is mounted to an automotive windshield wiper so that oscillation of the wiper produces movement of the device.

2. Description of the Prior Art

U.S. Pat. No. 5,933,991 to Gaul entitled "Decorative Attachment For Wiper Device" is believed to represent the most relevant prior art to the present invention. That device is attached to a wiper arm and to a wiper blade of a windshield wiper assembly. The device is believed to be operable, but the connection to the wiper blade and the wiper arm may be problematic because wiper blades are pivotally mounted with respect to wiper arms.

There is a need, therefore, for an improved apparatus for mounting such a device to a windshield wiper. The ideal device would not be attachable in part to a wiper arm and in part to a wiper blade.

However, in view of the prior art taken as a whole at the time the present invention was made, it was not obvious to those of ordinary skill how the identified need could be fulfilled.

SUMMARY OF INVENTION

The long-standing but heretofore unfulfilled need for an apparatus secured to a windshield wiper of a vehicle to display a sports team or other club or organization affiliation is now met in the form of a new, useful, and non-obvious invention.

The inventive structure includes a first part secured to a wiper arm of a windshield wiper assembly. The first part has a substantially flat structure and a length that substantially conceals the wiper arm and some of the wiper blade when secured to the wiper arm.

A first end of the first part is secured to the wiper arm near a radially innermost end of the wiper arm. A second end of the first part is secured to the wiper arm near a radially outermost end of the wiper arm.

The first part is adapted to look like a logo of a sports team, a flag, banner, or other item that is appropriate to display. Operation of the windshield wiper causes conjoint motion of the first part.

The invention may further include a second part secured to a vehicle body of the vehicle in non-moving relation to the vehicle body. The second part is disposed in cooperative relation to the first part and is adapted to look like a logo of a sports team or other article that is complementary to the first part.

The second part is secured to the vehicle body by at least one suction cup. In a preferred embodiment, the second part is secured to the vehicle body by a pair of laterally spaced apart suction cups.

In a first embodiment, the first end of the first part is secured to the radially innermost end of the wiper arm by a first pair of brackets disposed on opposite sides of the radially innermost end. The second end of the first part is secured to the radially outermost end of the wiper arm by a second pair of brackets disposed on opposite sides of the radially outermost part.

A slot is formed in each bracket of the first pair of brackets to provide a first pair of opposed slots and a first flexible tie extends through the first pair of opposed slots and around the radially innermost end of the wiper arm to secure the first end of said first part to the wiper arm.

A slot is also formed in each bracket of the second pair of brackets to provide a second pair of opposed slots. A second flexible tie extends through the second pair of opposed slots and around the radially outermost end of the wiper arm to secure the second end of the first part to the wiper arm.

In a variation of the first embodiment, a first slotted bracket is mounted on the radially inner end of the first part, directly under the wiper arm and a second slotted bracket is mounted on the radially outer end of the first part, directly under the wiper arm. A first tie secures the first bracket to the radially inner end of the wiper arm and a second tie secures the second bracket to the radially outer end of the wiper arm.

An important advantage of the present invention is that the part thereof that moves is mounted wholly on a wiper arm and not in part on a wiper arm and in part on a wiper blade.

Another important advantage is that the apparatus is easy to install and remove.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
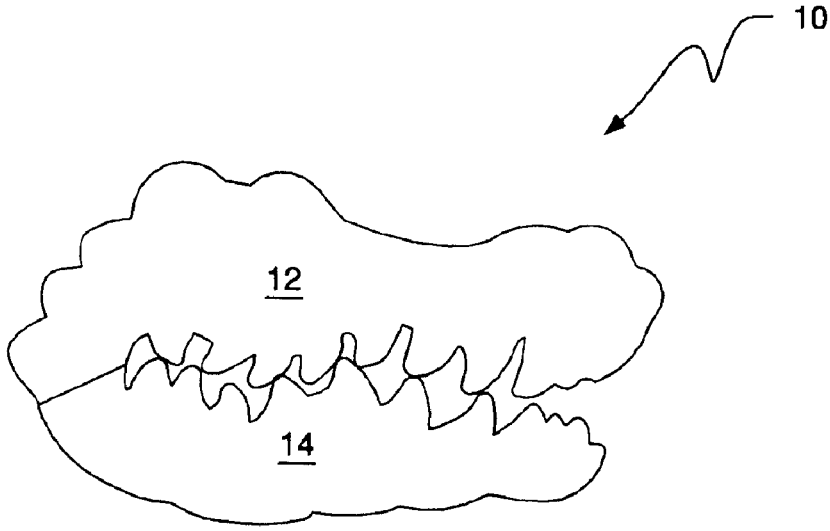
FIG. 1 is a front elevational view depicting an illustrative embodiment of the present invention when in a first position.
Figure 2:
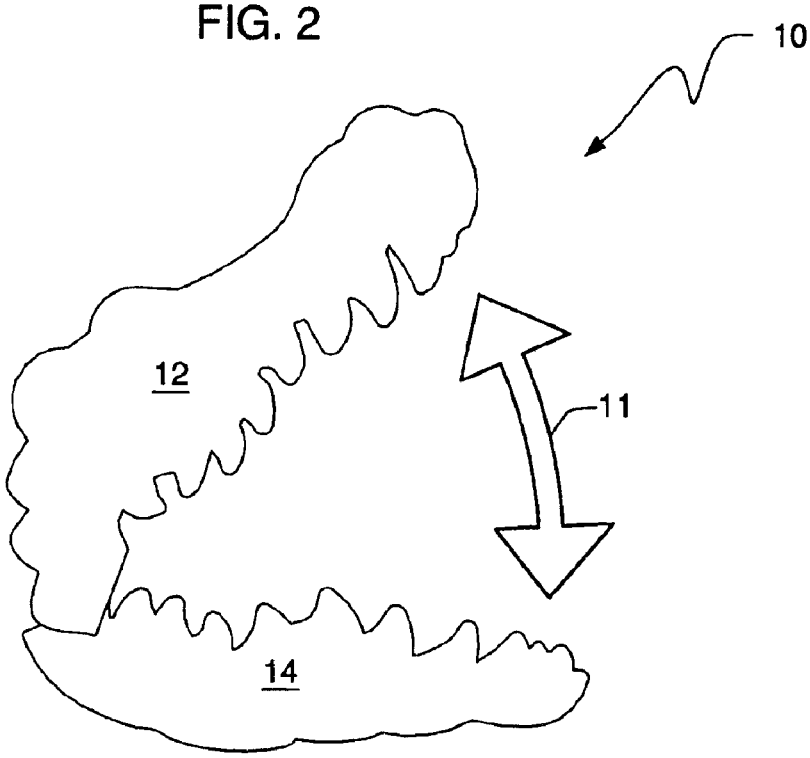
FIG. 2 is a view like that of FIG. 1 but depicting the device when in a second position.

Referring now to FIGS. 1 and 2, it will there be seen that an illustrative embodiment of the invention is denoted as a whole by the reference numeral 10.

Device 10 includes two (2) primary parts. First or top part 12 is mounted to a windshield wiper arm. Accordingly, it moves conjointly with said wiper arm and is sometimes herein referred to as movable part 12. It is not mounted to a windshield wiper blade. Second part or base 14 is immovably mounted to the body of a vehicle below the windshield in non-interfering relation to the windshield wiper assembly.

First part 12 is mounted to the rear side of the wiper arm, i.e., to the side that is away from the windshield. No part is positioned between the wiper blade and the windshield. More particularly, first and second parts 12 and 14 have front sides that are painted or otherwise decorated and rear sides that are not painted or otherwise decorated. The respective front sides face away from the windshield so that passers-by or other drivers may see the decorative side of said parts.

FIG. 1 depicts device 10 when movable part 12 and base 14 are in close juxtaposition to one another. As will become clear as this description proceeds, this position is created when a windshield wiper is in its fully "down" position.

In FIG. 2, movable part 12 and base 14 are spaced apart from one another. This position is created when the windshield wiper arm to which top part 12 is mounted has been driven away from its fully "down" position by a motor, not shown, that controls the motion of the windshield wiper arm to which said top part is secured.

Double-headed directional arrow 11 in FIG. 2 indicates the motion of top part 12 with respect to base 14, it being understood that the depicted angle of about forty-five degrees (45°) may be increased to nearly one hundred eighty degrees (180°) and decreased to zero degrees (0°) as depicted in FIG. 1 as the wipers operate.

In this illustrative example, top part 12 is shaped and colored to provide the appearance of the upper jaw and face of an alligator and base 14 is shaped and colored to provide the appearance of the lower jaw of an alligator. Top part 12 and base 14 may be provided in an infinite variety of shapes, sizes, and colorings. Said parts are preferably two-dimensional but three-dimensional parts are within the scope of this invention. The materials from which the parts are made should withstand the effects of prolonged exposure to the weather.

Figure 3:
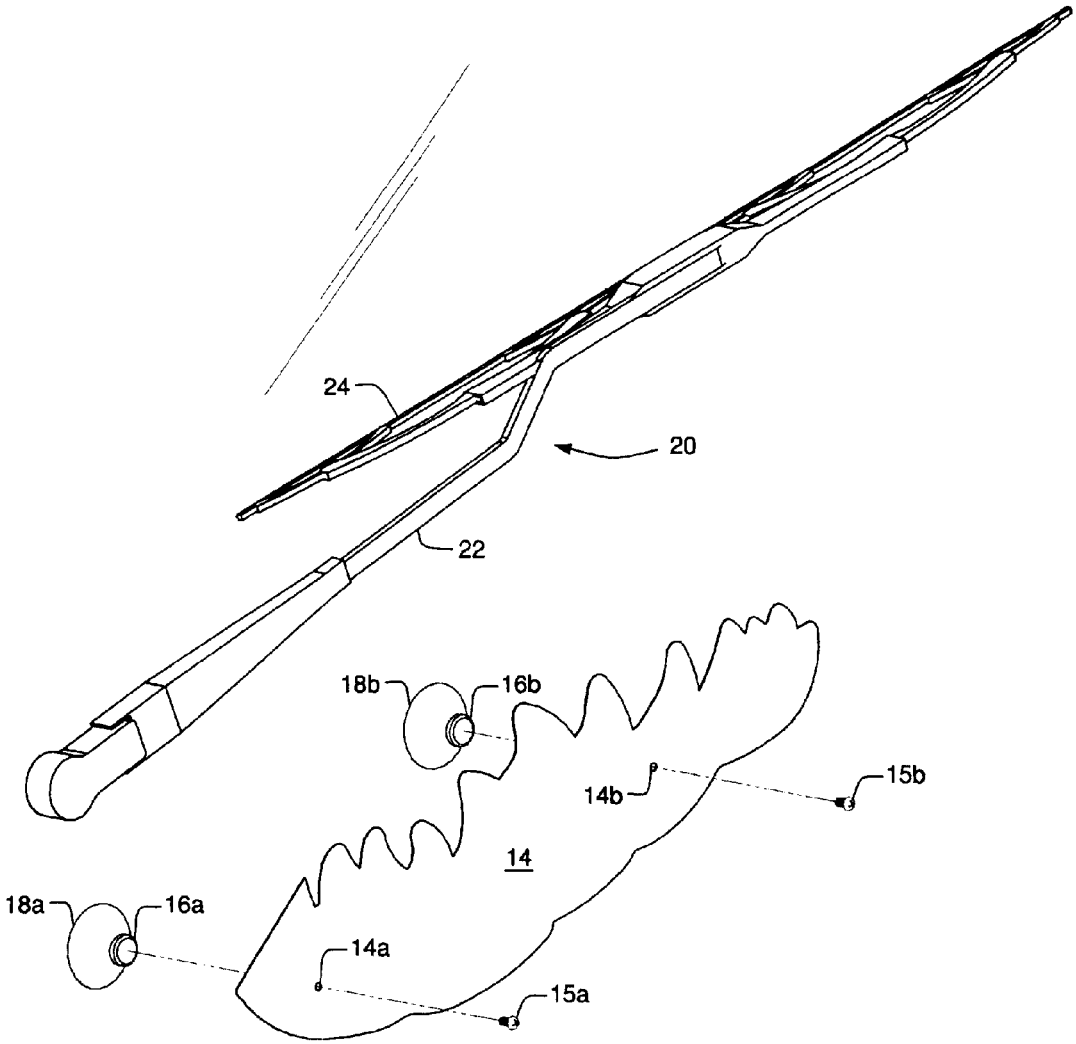
FIG. 3 is an exploded perspective view depicting the parts that secure the non-moving part of the device to a vehicle body.

FIG. 3 depicts the mounting means for non-moving base 14. Apertures 14*a*, 14*b* are formed in base 14 in laterally spaced relation to one another and are adapted to receive therethrough screws 15*a*, 15*b* or other suitable fastening means. The respective non-suction parts or bosses 16*a*, 16*b* of suction cups 18*a*, 18*b* are centrally bored to receive said screws as indicated by the assembly lines in FIG. 3. The respective suction parts of said suction cups 18*a*, 18*b* are secured to the body of the vehicle, just below the windshield. Base 14 does not move relative to the vehicle after installation.

Base 14 must be mounted in non-interfering relation to windshield wiper assembly 20. That assembly includes a wiper arm 22 and a wiper blade 24.

Figure 4:
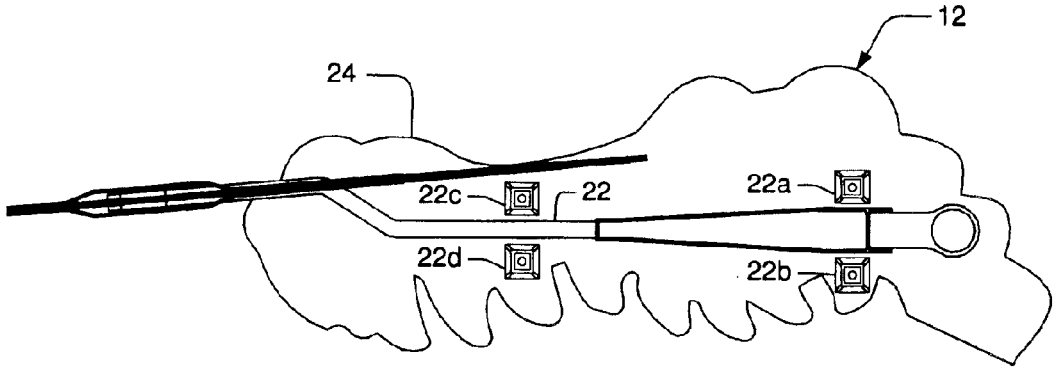
FIG. 4 is a rear elevational view depicting the parts that secure the moving part of the device to a wiper arm.
Figure 5:
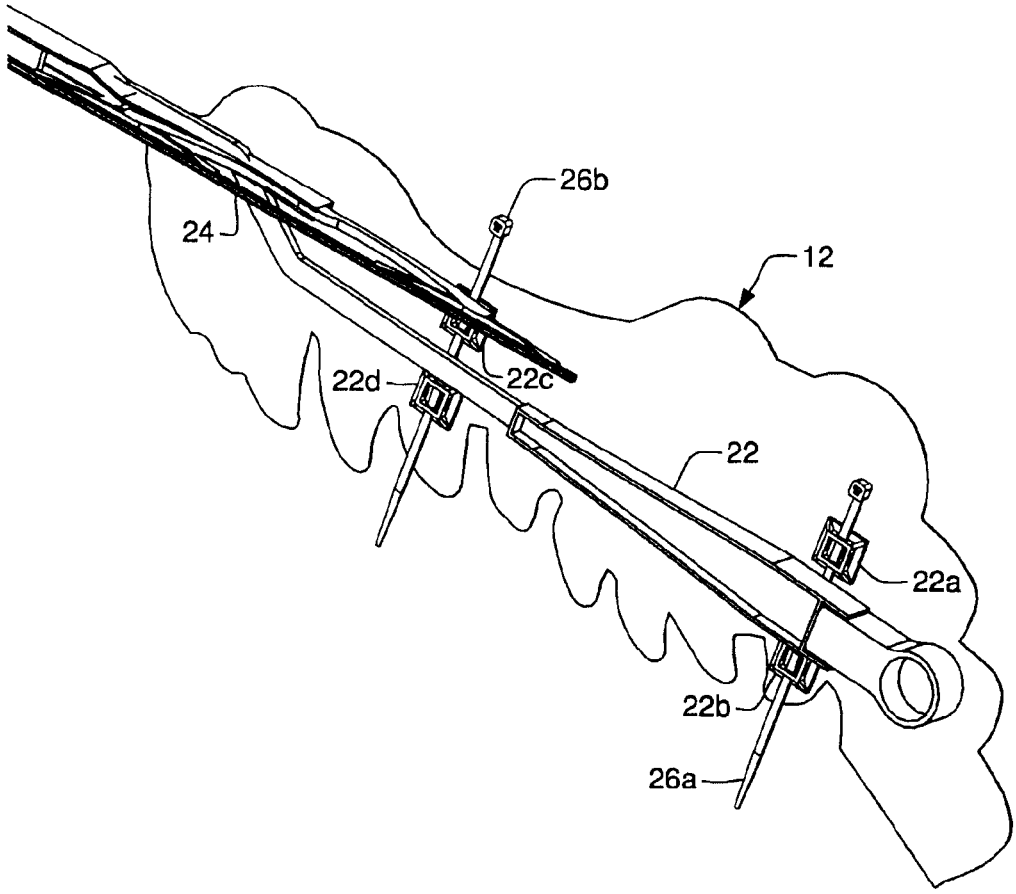
FIG. 5 is a rear perspective view depicting ties inserted into the brackets depicted in FIG. 4.

As best understood in connection with FIGS. 4 and 5, top part 12 is secured at two (2) laterally-spaced apart locations to wiper arm 22. Wiper arms vary in size and shape, so a user should first hold top part 12 relative to wiper arm 22 and move said top part relative to said wiper arm until it substantially covers wiper arm 22 and at least some of wiper blade 24 from view. A first pair of marks, not depicted, are made on opposite sides of wiper arm 22 near its radially innermost end and a second pair of marks, not depicted, are made on opposite sides of the wiper arm near its radially outermost end.

Brackets 22*a*, 22*b* are then secured into position on the rear side of top part 12 at the radially innermost pair of marks, and brackets 22*c*, 22*d* are secured into position at the radially outermost pair of marks. Wiper blade 24 is pivoted away from the windshield to facilitate the attachment of the brackets.

Although there are numerous well-known ways for attaching brackets to flat support surfaces, the preferred way is to provide brackets having "peel and seal" mounting means.

In this particular embodiment, an adhesive is applied to the back of each bracket 22*a–d* and an adhesive-resistant cover overlies said adhesive. After the positioning marks have been made, the covers are peeled from the backs of brackets 22*a–d* and the brackets are positioned in registration with their respective marks as depicted in FIGS. 4 and 5.

As suggested in FIG. 5, flexible ties 26*a* and 26*b* are then extended through slots formed in said brackets, wrapped around wiper arm 22, and tightened in a well-known way. Excess length may be trimmed by a pair of scissors.

Figure 6:
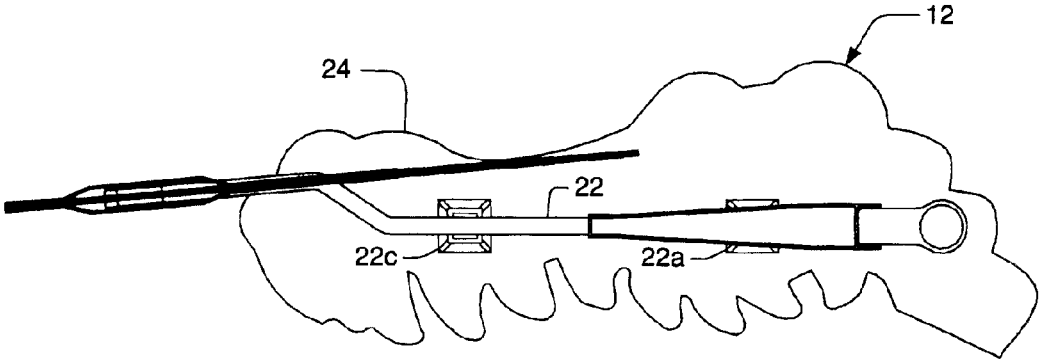
FIG. 6 depicts an alternative embodiment using only two brackets to secure the moving part of the device to the wiper arm.
Figure 7:
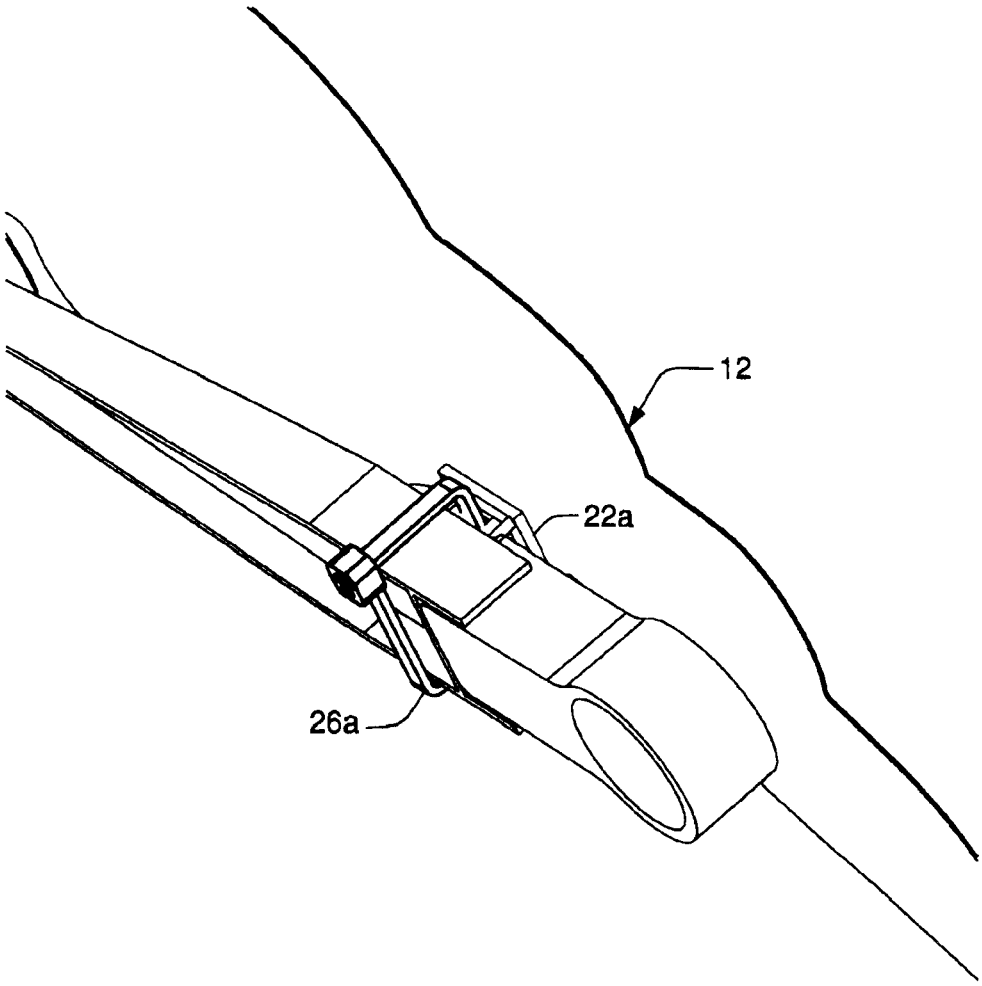
FIG. 7 is a rear perspective view depicting a tie when extended through the slots of a bracket and wrapped around the radially inward end of the wiper arm.

In an alternative embodiment, depicted in FIG. 6, the number of brackets is halved. Brackets 22*a* and 22*c* are mounted to first part 12 under wiper arm 22 at a radially inward and radially outward position, respectively, and ties 26*a*, 26*b* are used to secure the wiper arm to the brackets as indicated in FIG. 7.

A strip of felt, not shown, is secured to wiper blade 24 to prevent excessive wear of the wiper blade when operated in dry weather. The felt has about the same length as the wiper blade and is secured thereto by a pair of flexible felt-covered ties. The felt is positioned between the blade and the windshield.

A second embodiment of the invention eliminates base 14 and employ top part 12 only. Such an arrangement of parts is appropriate where it is desired to display a flag or other banner, or perhaps a profile of a sports team logo, or other insignia that is fully depicted by only one piece. Thus the drawings provided herein should also be interpreted as depicting the second embodiment having a top part 12 only and no base part 14.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus secured to a windshield wiper of a vehicle, comprising:

a first part secured to a wiper arm of said windshield wiper;

a first end of said first part secured to said wiper arm near a radially innermost end of said wiper arm;

a second end of said first part secured to said wiper arm near a radially outermost end of said wiper arm;

a second part secured to a vehicle body of said vehicle in non-moving relation to said vehicle body;

said second part having an appearance that is complementary to said first part;

said second part disposed in cooperative relation to said first part;

said second part secured to said vehicle body by a pair of laterally spaced apart suction cups;

said first end of said first part secured to said wiper arm near a radially innermost end of said wiper arm by a first pair of brackets disposed on opposite sides of said radially innermost end;

said second end of said first part secured to said wiper arm near a radially outermost end of said wiper arm by a second pair of brackets disposed on opposite sides of said radially outermost end;

a slot formed in each bracket of said first pair of brackets to provide a first pair of opposed slots;

a first flexible tie extending through said first pair of opposed slots and around said radially innermost end of said wiper arm to secure said first end of said first part to said wiper arm;

whereby oscillation of said wiper arm causes conjoint motion of said first part.

2. The apparatus of claim 1, further comprising:

a slot formed in each bracket of said second pair of brackets to provide a second pair of opposed slots;

a second flexible tie extending through said second pair of opposed slots and around said radially outermost end of said wiper arm to secure said second end of said first part to said wiper arm.

3. An apparatus secured to a windshield wiper of a vehicle, comprising:

a first part secured to a wiper arm of said windshield wiper;

a first end of said first part secured to said wiper arm near a radially innermost end of said wiper arm;

a second end of said first part secured to said wiper arm near a radially outermost end of said wiper arm;

a second part secured to a vehicle body of said vehicle in non-moving relation to said vehicle body;

said second part having an appearance that is complementary to said first part;

said second part disposed in cooperative relation to said first part;

said second part secured to said vehicle body by a pair of laterally spaced apart suction cups;

said first end of said first part secured to said wiper arm near a radially innermost end of said wiper arm by a first bracket mounted on said first part and disposed under said radially innermost end of said wiper arm;

said second end of said first part secured to said wiper arm near a radially outermost end of said wiper arm by a second bracket mounted on said first part and disposed under said radially outermost end of said wiper arm;

a first pair of slots formed in said first bracket;

a first flexible tie extending through said first pair of slots and around said radially innermost end of said wiper arm to secure said first end of said first part to said wiper arm.

4. The apparatus of claim 3, further comprising:

a second pair of slots formed in said second bracket;

a second flexible tie extending through said second pair of slots and around said radially outermost end of said wiper arm to secure said second end of said first part to said wiper arm.

* * * * *